US009480867B2

(12) United States Patent
Pace et al.

(10) Patent No.: US 9,480,867 B2
(45) Date of Patent: Nov. 1, 2016

(54) PROPORTIONAL DYNAMIC RATIO CONTROL FOR COMPRESSED AIR FOAM DELIVERY

(71) Applicant: Waterous Company, South St. Paul, MN (US)

(72) Inventors: Matthew C. Pace, Bozeman, MT (US); David William Johnson, Hastings, MN (US); Thomas Joseph Mettler, Hudson, WI (US)

(73) Assignee: Waterous Company, South St. Paul, MN (US)

( * ) Notice: Subject to any disclaimer, the term of this patent is extended or adjusted under 35 U.S.C. 154(b) by 943 days.

(21) Appl. No.: 13/673,524

(22) Filed: Nov. 9, 2012

(65) Prior Publication Data

US 2013/0118763 A1 May 16, 2013

Related U.S. Application Data

(60) Provisional application No. 61/558,556, filed on Nov. 11, 2011.

(51) Int. Cl.

| | |
|---|---|
| ***A62C 2/00*** | (2006.01) |
| ***A62C 5/02*** | (2006.01) |
| ***B01F 15/00*** | (2006.01) |
| ***B01F 15/04*** | (2006.01) |
| ***B01F 3/04*** | (2006.01) |

(52) U.S. Cl.

CPC ..... *A62C 5/022* (2013.01); *B01F 3/04446* (2013.01); *B01F 3/04992* (2013.01); *B01F 15/00136* (2013.01); *B01F 15/00162* (2013.01); *B01F 15/042* (2013.01)

(58) Field of Classification Search

CPC ..... A62C 5/022; B01F 3/04446; B01F 3/04992; B01F 15/00136; B01F 15/00162; B01F 15/042

USPC ..... 169/46, 62, 24, 44, 13–16; 239/398, 239/399, 400, 407, 146, 147, 148, 172, 722, 239/749

See application file for complete search history.

(56) References Cited

U.S. PATENT DOCUMENTS

| | | | | | |
|---|---|---|---|---|---|
| 3,075,749 | A * | 1/1963 | Mason, Jr. | B01F 3/04446 | 222/145.7 |
| 4,189,005 | A * | 2/1980 | McLoughlin | A62C 27/00 | 169/13 |
| 4,981,178 | A * | 1/1991 | Bundy | A62C 5/02 | 169/13 |
| 5,113,945 | A * | 5/1992 | Cable | A62C 5/02 | 169/14 |
| 5,145,014 | A * | 9/1992 | Eberhardt | A62C 5/02 | 169/13 |
| 5,255,747 | A * | 10/1993 | Teske | A62C 5/02 | 169/15 |
| 6,009,953 | A * | 1/2000 | Laskaris | A62C 5/02 | 169/13 |
| 6,155,351 | A * | 12/2000 | Breedlove | A62C 5/02 | 169/14 |
| 6,314,996 | B1 * | 11/2001 | Borglum | A01B 69/022 | 137/565.29 |
| 8,613,325 | B2 | 12/2013 | Guse | | |

(Continued)

*Primary Examiner* — Justin Jonaitis

(74) *Attorney, Agent, or Firm* — Todd R. Fronek; Larkin Hoffman Daly & Lindgren, Ltd.

(57) ABSTRACT

A compressed air foam delivery system includes a control unit to monitor and/or adjust components within the system so as to deliver a compressed air foam agent mixture with a desired agent:air ratio at a desired flow rate to one or more active discharges. In one embodiment, the control unit can be equipped to control one or more of a pump engine, water pump, foam delivery unit and air compressor so as to deliver and maintain the desired ratio of agent mixture at the desired flow rate.

13 Claims, 3 Drawing Sheets

(56) References Cited

U.S. PATENT DOCUMENTS

2004/0177975 A1* 9/2004 Laskaris ..... A62C 5/02 169/13
2005/0222287 A1 10/2005 Roberts
2008/0271901 A1* 11/2008 Decker ..... A62C 27/00 169/46
2009/0218110 A1 9/2009 Laskaris et al.
2009/0260836 A1* 10/2009 Laskaris ..... A62C 5/02 169/24
2011/0064591 A1* 3/2011 McLoughlin ..... F04B 17/06 417/321

* cited by examiner

PROPORTIONAL DYNAMIC RATIO CONTROL FOR COMPRESSED AIR FOAM DELIVERY

CROSS-REFERENCE TO RELATED APPLICATION

This application claims priority under 35 U.S.C. §119(e) to U.S. Provisional Patent Application Ser. No. 61/558,556 filed on Nov. 11, 2011, and incorporated herein by reference.

BACKGROUND

Compressed air foam is used to extinguish fires and is generally comprised of a combination of water and a foam concentrate solution mixed together to form an agent mixture. The agent mixture is then subjected to compressed air so as to create a foam mixture for delivery to a fire. Depending on characteristics of the fire (e.g., related to size, fuel source, environmental factors) different agent mixture ratios and/or flow rates are selected to extinguish the fire. Current air foam delivery systems are managed manually by an operator so as to achieve the desired agent mixture ratio and flow rate depending on variables of the system.

SUMMARY

A compressed air foam delivery system includes a control unit to dynamically monitor and/or adjust components within the system so as to deliver a compressed air foam agent mixture with a desired agent:air ratio at a desired flow rate to one or more active discharges. In one embodiment, the control unit can be equipped to control one or more of a pump engine, water pump, foam delivery unit and air compressor so as to deliver and maintain the desired ratio of agent mixture at the desired flow rate.

DETAILED DESCRIPTION OF THE INVENTION

Figure 1:
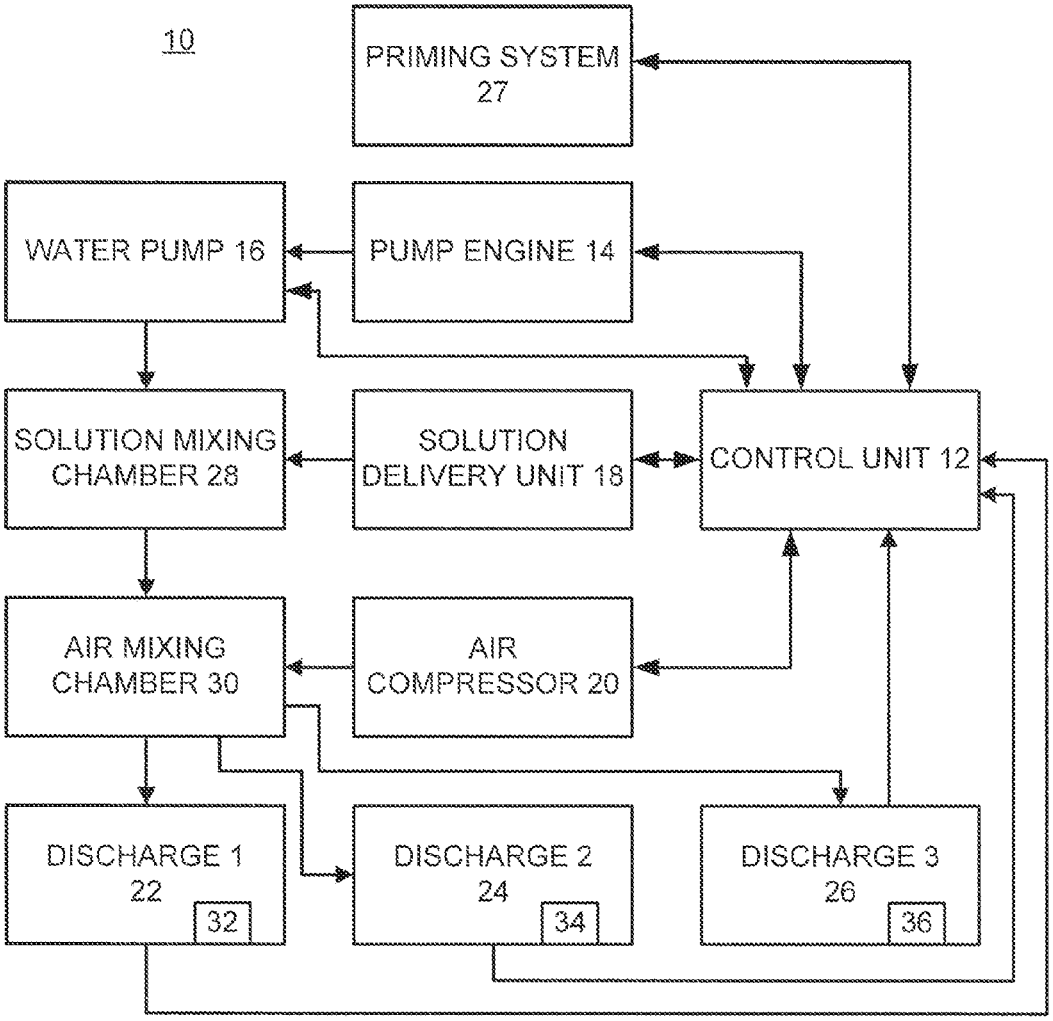
FIG. 1 is a schematic block diagram of a compressed air foam delivery system.

FIG. 1 is a schematic block diagram of a compressed air foam delivery system 10 useful for delivering a firefighting agent mixture of foam for purposes of extinguishing a fire. System 10 is configured to deliver a foam mixture of water, solution and air at desired proportions. Moreover, system 10 monitors the foam mixture delivered and adjusts components to maintain the desired foam mixture. For clarity purposes, "agent mixture" as used herein will refer to a mixture of water and a solution of firefighting agent. Moreover, "foam mixture" as used herein will refer to a mixture including water, solution (i.e., agent mixture) and air.

In one embodiment, system 10 is supported by a fire truck and can be configured to draw mechanical and/or electrical power from the fire truck. System 10 includes a control unit 12 operable to dynamically control components within the system 10 in order to deliver a foam mixture having a desired agent:air ratio (i.e., at a desired proportion of agent mixture to air) at a desired flow rate. In particular, control unit 12 is operably coupled to a pump engine 14, a water pump 16, a solution delivery unit 18 and an air compressor 20. Through control of these components, control unit 12 delivers a desired foam mixture at a desired flow rate to one or more discharges 22, 24 and 26. Although three discharges 22, 24 and 26 are herein illustrated, more or less discharges may be utilized in delivering a foam mixture.

In one embodiment, control unit 12 monitors and adjusts at least one of the following variables in delivering a foam mixture to one or more of the discharges 22, 24 and 26: revolutions per minute of pump engine 14, water pressure within water pump 16, water flow rate within water pump 16, solution injection percentage delivered by solution delivery unit 18, air pressure within air compressor 20, and air flow rate within air compressor 20. Additionally, control unit 12 monitors one or more of the agent:air ratio and the flow rate of foam mixture delivered to the discharges 22, 24 and 26. The monitoring of ratio and flow rate at the discharges 22, 24, 26 provides feedback to control unit 12 such that components controlled by the control unit 12 can be adjusted in order to deliver the desired ratio and flow rate of foam mixture to active discharges 22, 24, 26. To this end, a situation may arise where one or more of the discharges is active and one or more of the discharges is inactive. Circumstances may dictate that one of the inactive discharges be activated (i.e., brought online) so as to actively deliver foam mixture. Having an additional active discharge (or shutting down an active discharge) alters characteristics within system 10 such that control unit 12 can dynamically adjust components within the system 10 such that each active discharge delivers the desired ratio and flow rate of foam mixture.

In order to deliver the foam mixture to active discharges, pump engine 14 operates to provide power to the water pump 16, which can be connected to a suitable water source (not shown). Example water sources include a tank on the fire truck, a draft source such as a pond or lake coupled to an intake of the fire truck and a pressurized source such as a fire hydrant. In one embodiment, control unit 12 is operably coupled to one or more intake valves that connect pump 16 with a water source. Pump engine 14, in one embodiment, is a separate combustion engine that operates at a particular revolutions per minute (RPM) setting that is controllable by the control unit 12. In another embodiment, the pump engine 14 can be a main engine for the fire truck, where the pump 16 is coupleable to the main engine through a power take off assembly. In any event, control unit 12 is configured to increase or decrease the RPM setting of the pump engine 14 in order to achieve a desired ratio and flow rate of foam mixture.

In one embodiment, control unit 12 is further coupled to a priming system 27 capable of priming pump 16. In particular, the priming system 27 can include a pump to replace air within pump 16 with water. In a further embodiment, the priming system 27 can include a pressure sensor to indicate when the pump 16 is primed. Once pump 16 is primed, control unit 12 can operate to turn off priming system 27. In any event, the control unit 12 is configured to prime and operate pump 16 prior to implementation and operation of the solution delivery unit 18 and/or the air compressor 20. In particular, the control unit 12 can detect a pressure in the water pump 16. If no or low pressure is detected, the priming system 27 is activated by the control unit 12 to prime pump 16. Once control unit 12 detects pump 16 is primed by detecting a particular pressure level, the solution delivery unit 18 and air compressor 20 can be operated to deliver a foam mixture.

Upon operation of the pump engine 14, water pump 16 operates to deliver water to a solution mixing chamber 28. Within solution mixing chamber 28, solution delivery unit 18 operates to inject concentrate solution into the water supplied by the water pump 16 in a proportion so as to form a water/solution mixture, also referred to herein as an agent mixture. To this end, the solution delivery unit 18 can include a pump coupled to chamber 28 to deliver solution thereto. In one embodiment, the percentage of solution introduced into the water can be in a range of approximately 0.3%-6.0%. Control unit 12 is operable to control solution delivery unit 18 so as to adjust the percentage of solution delivered to the solution mixing chamber 28 in order to produce an agent mixture with a desired water to solution proportion. In one embodiment, production of the agent mixture can be performed in a manner similar to that disclosed in U.S. Patent Application Publication No. 2008/0035201, herein incorporated by reference. For example, a conductivity of water supplied to the chamber 28 can be compared with a conductivity of the agent mixture exiting chamber 28. These conductivity readings can be supplied to control unit 12 in order to provide a desired water to solution ratio for the agent mixure.

From solution mixing chamber 28, the agent mixture travels to an air mixing chamber 30, where compressed air from the air compressor 20 is introduced into the agent mixture to create a foam mixture. Controller 12 is operable to adjust the air compressor 20, in particular with regards to a signal indicative of an air pressure setting and/or an air flow setting within the air compressor 20. Once air is introduced to the agent mixture within the air mixing chamber 30, the foam mixture can be discharged through the one or more discharges 22, 24 and 26. Each of the discharges 22, 24, and 26 can be equipped with a flow sensor and/or a conductuity sensor (generally indicated as respective sensor assemblies 32, 34, 36) that can measure the flow rate and ratio of the foam mixture that is discharged from air mixing chamber 30. Based on the readings from these sensor assemblies 32, 34, 36, control unit 12 can adjust one or more settings of the pump engine 14, water pump 16, solution delivery unit 18 and air compressor 20 in order to achieve the desired mixture ratio and flow rate at each active discharge.

Figure 2:
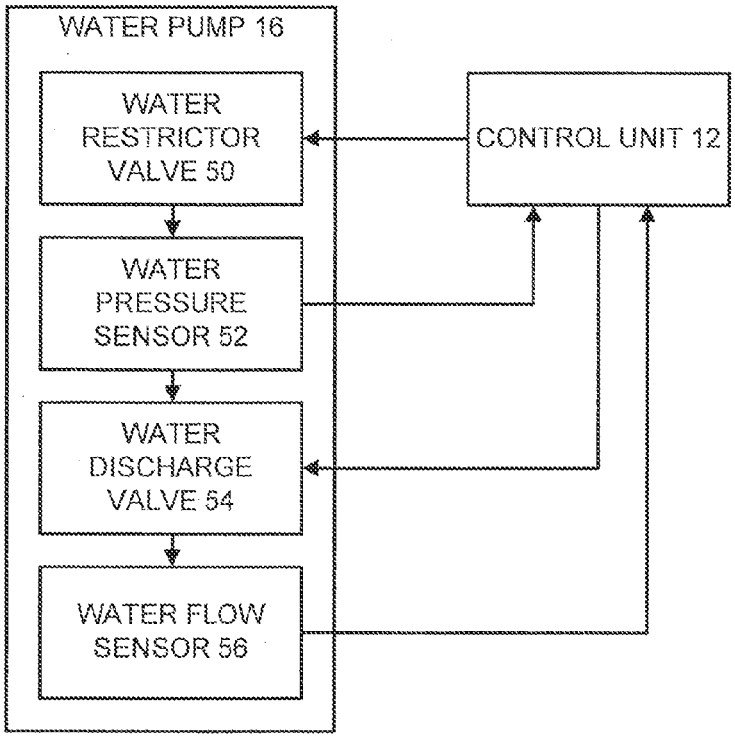
FIG. 2 is a schematic block diagram of components of a water pump connected to a control unit.

FIG. 2 is a schematic diagram of components of the water pump 16 in relation to control unit 12. As illustrated, water pump 16 includes a water restrictor valve 50 controlling flow of water into pump 16, a water pressure sensor 52 providing a signal to control unit 12 indicative of water pressure within pump 16, a water discharge valve 54 controlling flow of water exiting water pump 16 and a water flow sensor 56 measuring flow of water exiting pump 16. Control unit 12 is configured so as to alter a setting (i.e. a flow rate) for water restrictor valve 50 and water discharge valve 54. In particular, adjustment of the water restriction valve 50 can alter the water pressure within water pump 16. Similarly, adjustment of water discharge valve 54 can adjust a water flow rate exiting water pump 16. In order to determine proper control of water restriction valve 50 and water discharge valve 54, control unit 12 is coupled to the water pressure sensor 52 and water flow sensor 56, respectively. In particular, water pressure sensor 52 provides an indication of the water pressure within water pump 16. Moreover, the water flow sensor 56 provides a reading of water flow exiting water pump 16. By monitoring the water pressure sensor 52 and/or water flow sensor 56, the water restrictior valve 50 and water discharge valve 54 can be adjusted as necessary in order to provide a foam mixture to one or more of the discharges 22, 24, or 26 with a desired agent:air mixture ratio at a desired flow rate.

Figure 3:
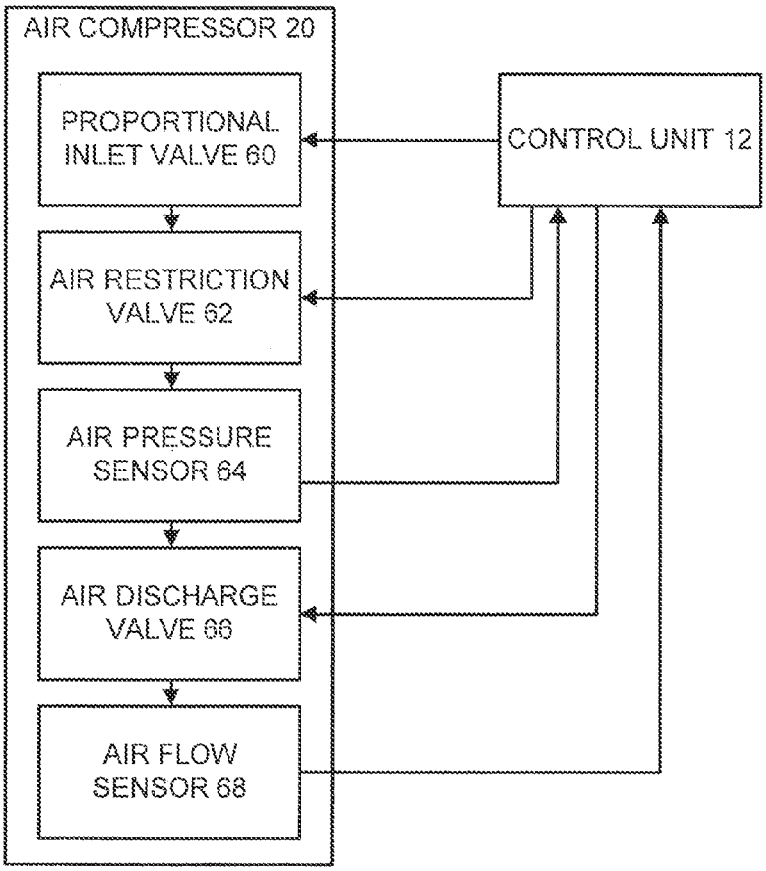
FIG. 3 is a schematic block diagram of components of an air compressor connected to a control unit.

FIG. 3 is a schematic diagram of components of air compressor 20 and connection to control unit 12. In particular, air compressor 20 includes a proportional inlet valve 60, an air restrictor valve 62, an air pressure sensor 64, an air discharge valve 66 and an air flow sensor 68. In one embodiment, proportional inlet valve 60 is a proportional solenoid valve that can be electrically connected to control unit 12. Control unit 12 is operable to control a setting (i.e., a flow rate) for proportional inlet valve 60, air restrictor valve 62 and/or air discharge valve 66. Additionally, control unit 12 is configured to receive readings from air pressure sensor 64 and air flow sensor 68. In order to deliver a foam mixture at a desired ratio of agent:air at a desired flow rate to the discharges 22, 24, 26, control unit 12 can adjust one or more of the proportional inlet valve 60, air restrictor valve 62 and air discharge valve 66 depending upon a reading from air pressure sensor 64 and/or air flow sensor 68.

Figure 4:
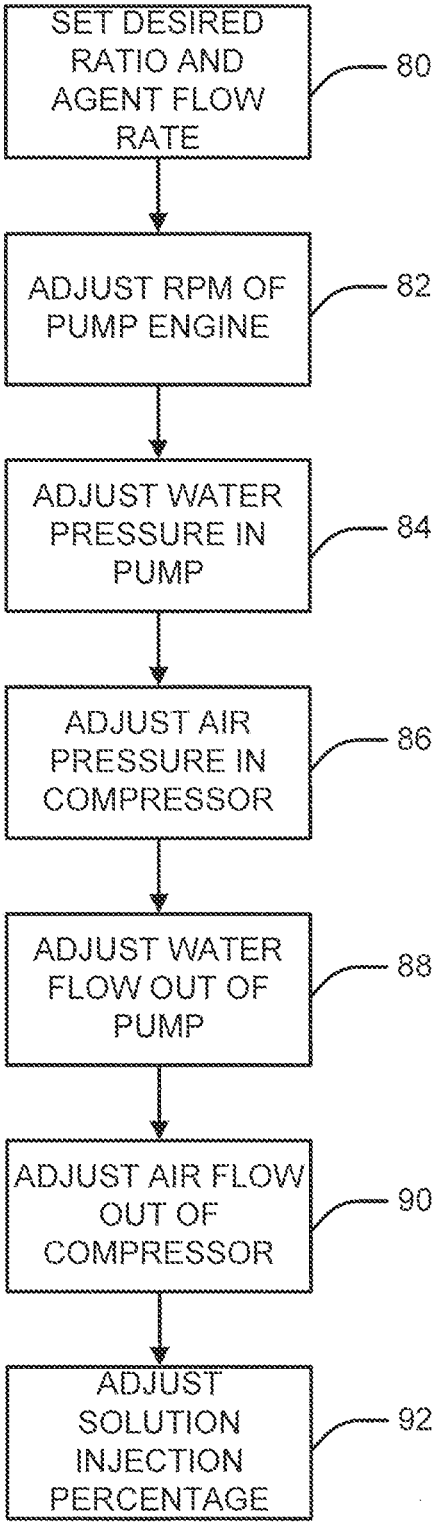
FIG. 4 is a flow diagram of a method for controlling delivery of a foam mixture with a desired agent:air ratio at a desired flow rate to one or more discharges.

FIG. 4 is a schematic flow diagram identifying sequential steps for operation of control unit 12 in delivering a foam mixture at a desired ratio and desired flow rate. At step 80, a desired ratio and flow rate is set, for example by an operator or predetermined as desired. For example, the operator may evaluate a fire and determine that a flow rate of 300 gallons per minute of 2:1 agent:air compressed air foam mixture is desired to extinguish the fire. After initiation of the system 10 and selection of the desired ratio and flow rate, control unit 12 monitors and adjusts parameters within the system 10 as necessary in order to deliver and maintain the desired ratio and flow rate set at step 80. For example, at step 82, the RPM setting of pump engine 14 can be adjusted. Next, the water pressure in the pump is adjusted at step 84 and the air pressure in the compressor is adjusted at step 86. Control unit 12 can then operate to adjust the water flow out of the water pump 16 at step 88 and adjust the air flow out of the air compressor 20 at step 90. Moreover, the control unit 12 can adjust the solution injection percentage of solution delivery unit 18 at step 92. During operation, one or more of the steps 80 through 92 can be monitored and/or adjusted in order to maintain delivery of foam mixture at a desired ratio and flow rate in order to extinguish a fire.

Although the present invention has been described with reference to preferred embodiments, workers skilled in the art will recognize that changes can be made in form and detail without departing from the spirit and scope of the present invention.

What is claimed is:

1. A compressed air foam delivery system, comprising:

an engine;

a solution mixing chamber;

a water pump operably coupled to the engine and configured to deliver water to the solution mixing chamber;

a solution delivery system configured to deliver solution to the solution mixing chamber to produce an agent mixture;

an air mixing chamber configured to receive the agent mixture;

an air compressor coupled to the air mixing chamber to inject air into the agent mixture and produce a foam mixture;

a plurality of discharges each configured to receive the foam mixture from the air compressor and direct the foam mixture to a target site, each of the plurality of discharges including a sensor assembly that measures flow rate and ratio of the foam mixture at each respective discharge; and a control unit operably coupled with sensor assemblies of the plurality of discharges, the engine and one or more of the water pump, the solution delivery system and the air compressor, the control unit configured, based on measurement of flow rate and ratio of the foam mixture from the sensor assemblies, to monitor and adjust a revolutions per minute setting of the engine and monitor and adjust parameters related to said one or more of the water pump, the solution delivery system and the air compressor to deliver the foam mixture to each of the plurality of discharges with a desired agent: air ratio at a desired flow rate.

2. The system of claim 1, further comprising a water restrictor valve controlling a flow of water to the water pump and wherein the control unit is configured to adjust the water restrictor valve to deliver the foam mixture with the desired agent:air ratio at the desired flow rate.

3. The system of claim 2, further comprising a water pressure sensor coupled to the water pump, measuring a water pressure in the water pump and operably coupled to the control unit to provide a signal indicative of the water pressure.

4. The system of claim 1, further comprising a water discharge valve coupled to the water pump and controlling a flow of water discharged from the water pump and wherein the control unit is configured to adjust the water discharge valve to deliver the foam mixture with the desired agent:air ratio at the desired flow rate.

5. The system of claim 4, further comprising a water flow sensor coupled to the water discharge valve to measure a water flow out of the water discharge valve and provide a signal indicative of the water flow to the control unit.

6. The system of claim 1, wherein the control unit is configured to adjust a percentage of solution in the agent mixture so as to deliver the foam mixture with the desired agent:air ratio at the desired flow rate.

7. The system of claim 1, further comprising a proportional inlet valve configured to provide air to the air compressor, wherein the control unit is operably coupled to the proportional inlet valve to adjust a flow rate of the proportional inlet valve to deliver the foam mixture with the desired agent:air ratio at the desired flow rate.

8. The system of claim 1, further comprising an air restrictor valve, wherein the control unit is operably coupled to the air restrictor valve to control a flow rate of air provided to the air mixing chamber to deliver the foam mixture with the desired agent:air ratio at the desired flow rate.

9. The system of claim 8, further comprising an air pressure sensor configured to measure pressure of air in the air mixing chamber and provide a signal indicative thereof to the control unit.

10. The system of claim 1, further comprising an air discharge valve controlling air flow to the air mixing chamber, wherein the control unit is configured to adjust a flow rate of the air discharge valve to deliver the foam mixture with the desired agent:air ratio at the desired flow rate.

11. The system of claim 10, further comprising an air flow sensor configured to measure air flow from the air discharge valve and configured to provide a signal indicative thereof to the control unit.

12. The system of claim 1, further comprising a second discharge configured to receive the foam mixture from the air compressor, wherein the control unit is further configured to monitor the agent:air ratio and flow rate of the foam mixture delivered to the first-mentioned discharge and the second discharge and adjust operation of the engine and said one or more of the water pump, the solution delivery system and the air compressor to deliver the foam mixture to the first-mentioned discharge and the second discharge at the desired agent:air ratio at the desired flow rate.

13. The system of claim 1, further comprising a priming system coupled to the water pump, wherein the control unit is further configured to detect if the water pump is primed and operate the priming system to prime the water pump.

* * * * *